US009062552B2

(12) United States Patent
Holmes

(10) Patent No.: US 9,062,552 B2
(45) Date of Patent: Jun. 23, 2015

(54) TURBINE ENGINE STATOR AND METHOD OF ASSEMBLY OF THE SAME

(75) Inventor: Lewis J. Holmes, Derby (GB)

(73) Assignee: ROLLS-ROYCE plc, London (GB)

( * ) Notice: Subject to any disclaimer, the term of this patent is extended or adjusted under 35 U.S.C. 154(b) by 499 days.

(21) Appl. No.: 13/591,836

(22) Filed: Aug. 22, 2012

(65) Prior Publication Data

US 2013/0280054 A1 Oct. 24, 2013

(30) Foreign Application Priority Data

Sep. 9, 2011 (GB) ..... 1115581.9

(51) Int. Cl.
*F01D 9/02* (2006.01)
*F01D 9/04* (2006.01)
*F01D 9/00* (2006.01)

(52) U.S. Cl.
CPC ..... *F01D 9/041* (2013.01); *Y10T 29/49323* (2015.01); *F05D 2240/12* (2013.01); *F05D 2250/38* (2013.01); *F01D 9/042* (2013.01); *F05D 2240/80* (2013.01); *F05D 2270/301* (2013.01); *F01D 9/00* (2013.01); *F01D 9/044* (2013.01)

(58) Field of Classification Search
CPC .. F01D 9/041; F05D 2240/12; F05D 2250/38
USPC ..... 415/191, 211.2
See application file for complete search history.

(56) References Cited

U.S. PATENT DOCUMENTS

| | | | | |
|---|---|---|---|---|
| 7,234,914 | B2 * | 6/2007 | Usab et al. | 415/1 |
| 7,444,802 | B2 * | 11/2008 | Parry | 60/226.1 |
| 2009/0317237 | A1 * | 12/2009 | Wood et al. | 415/119 |
| 2011/0110763 | A1 * | 5/2011 | Tecza et al. | 415/119 |
| 2011/0164967 | A1 | 7/2011 | Elorza Gomez et al. | |

FOREIGN PATENT DOCUMENTS

| | | | |
|---|---|---|---|
| FR | 2 205 927 | A5 | 5/1974 |
| GB | 2 046 849 | A | 11/1980 |
| GB | 2 401 654 | A | 11/2004 |
| GB | 2 432 637 | A | 5/2007 |
| GB | 2 475 140 | A | 5/2011 |

OTHER PUBLICATIONS

Jan. 3, 2012 Search Report issued in British Patent Application No. GB1115581.9.

* cited by examiner

*Primary Examiner* — Ninh H Nguyen
(74) *Attorney, Agent, or Firm* — Oliff PLC

(57) ABSTRACT

A turbine engine stator stage includes a plurality of vanes with each of the plurality of vanes having a camber angle. The plurality of vanes is arranged in a plurality of groups with each group including a pre-determined sequence of vanes. The ordering of vanes within each group is determined by the camber of the individual vanes. This results in an arrangement of vanes within the stator stage which can modify the flow characteristics of the air entering the stator stage to reduce the circumferential pressure variation in the flow region immediately downstream of the stator stage.

12 Claims, 7 Drawing Sheets

TURBINE ENGINE STATOR AND METHOD OF ASSEMBLY OF THE SAME

This invention claims the benefit of UK Patent Application No. 1115581.9, filed on 9 Sep. 2011, which is hereby incorporated herein in its entirety.

FIELD OF THE INVENTION

This invention relates to a stator for a turbomachine and particularly, but not exclusively, to a stator for a gas turbine engine, together with a method for assembling such a stator.

BACKGROUND TO THE INVENTION

As shown in FIG. 1, a conventional axial flow gas turbine engine 10 comprises an air intake 11, a low pressure compressor (or fan) 12, an intermediate pressure compressor 13, a high pressure compressor 14, a combustor 15, a high pressure turbine 16, an intermediate pressure turbine 17, a low pressure turbine 18, and an exhaust nozzle 19.

In operation, air is drawn into the engine 10 through the intake 11 and accelerated by the fan 12, to produce two air flows: a first air flow which enters the intermediate pressure compressor 13 and a second air flow which bypasses the core of the engine to provide direct propulsive thrust.

The first air flow entering the intermediate pressure compressor 13 is compressed before entering the high pressure compressor 14 where further compression takes place.

The compressed air leaving the high pressure compressor 14 is directed into the combustor 15 where it is mixed with fuel and the resulting mixture is combusted. The high pressure combustion products then rapidly expand as they pass through and drive the high, intermediate and low pressure turbines 16, 17 and 18. The gas leaving the low pressure turbine 18 is then exhausted through the exhaust nozzle 19 and provides additional propulsive thrust.

The high, intermediate and low pressure turbines 16, 17 and 18 respectively drive the high and intermediate pressure compressors 14 and 13 and the fan 12 by means of separate interconnecting shafts.

Typical axial-flow compressors and turbines each generally comprise a plurality of stages, each of which in turn comprises a stator stage which is mounted on the casing inner wall and a rotor stage which is rotatably driven in the casing.

Each stator stage will typically comprise a plurality of individual stator vanes arranged as an annular array supported between respective inner and outer supports (or "platforms"), with each individual stator vane extending substantially radially between the platforms. The stator vanes in each stator stage are configured to straighten the air flow before it enters the adjacent rotor stage.

Due to the need to support the compressor and turbine portions of the engine within the engine casing, it is known to use substantial mounting pylons or struts within the engine, for example downstream of the intermediate pressure compressor. These struts can cause disruption to the air flow through the compressor which in turn can cause a circumferential pressure variation around the engine's air intake. This can reduce the efficiency of the engine and may adversely stress the fan and compressor blades.

It is an object of the present invention to provide an improved stator stage which ameliorates the above-mentioned problems, and a method for assembling such a stator stage.

STATEMENTS OF INVENTION

According to a first aspect of the present invention there is provided a method of assembling a turbine engine stator stage comprising a plurality of vanes, each of the plurality of vanes having a camber angle, the method comprising the steps of:

(a) selecting a group of vanes based on the camber angle of each of the plurality of vanes;

(b) arranging the vanes within the group to form a predetermined sequence of vanes;

(c) repeating steps (a) and (b) to form a plurality of groups of vanes; and (d) positioning the groups of vanes in a pre-determined order such that each group of vanes is positioned at a predefined circumferential position in the assembled stator stage.

By varying the camber angle of the individual stator vanes positioned at different circumferential positions around the assembled stator stage, it is possible to achieve approximate uniformity across the flow region immediately downstream of the stator vanes.

Such variation in the camber of the individual stator vanes around the circumference of the assembled stator stage is termed "cyclic camber".

Optionally, method step (a) comprises the steps of:

(a1) selecting a nominal vane camber angle for the stator stage;

(a2) selecting at least one overcamber angle, being greater than the nominal camber angle, and at least one undercamber angle, being less than the nominal camber angle; and (a3) selecting a group of vanes comprising one nominally cambered vane, at least one over-cambered vane, and at least one under-cambered vane.

In one embodiment of the invention, the stator includes a plurality of groups of stator vanes which include five different camber angles; these being defined as a nominal camber angle, 'nominal+4°' and 'nominal+8°' camber angles (termed "overcamber") and 'nominal−4°' and 'nominal−8°' camber angles (termed "undercamber").

While an ideal solution to the problem of providing uniformity across the flow region immediately downstream of the stator vanes might require each individual vane to have a unique camber angle, such a stator stage would be difficult and extremely expensive to manufacture.

In order to simplify the manufacture of the stator stage it is therefore desirable to use a minimum quantity of discretely cambered vanes in an assembled stator stage.

Optionally, method step (b) comprises the steps of:

(b1) selecting a nominally cambered vane; and (b2) positioning at least one over-cambered vane on a first side of the nominally cambered vane and at least one under-cambered vane on an opposite, second side of the nominally cambered vane.

By arranging the vanes in groups in which a nominally cambered vane is positioned between one or more overcambered vanes and one or more undercambered vanes, it is possible to assemble the groups of vanes separately. The assembled groups of vanes may themselves then be positioned within the intermediate pressure compressor casing to form the assembled stator stage.

This assembly technique makes the stator stage easier and quicker to assemble.

Optionally, each of the nominally cambered vane and an endmost of each of the undercambered and overcambered vanes in a group of vanes has a respective inspection feature, each inspection feature having a length, the method comprising the additional steps of:

(e) measuring the length and circumferential position of each of the inspection features;

(f) identifying the nominally cambered vane, and the undercambered and overcambered vanes at respective opposite ends of the sequence of vanes in each group on the basis of the length of the respective inspection feature;

(g) confirming that the circumferential position of each of the nominally cambered vanes and the overcambered and undercambered end vanes in each group matches the corresponding predefined circumferential position; and (h) confirming that the sequence of vanes in each group matches the respective pre-determined sequence on the basis of the quantities of overcambered and undercambered vanes which are present on respective opposite sides of the nominally cambered vane.

Once the pre-assembled groups of vanes have been positioned within the compressor casing, it can be difficult to check that the nominally cambered vanes are situated at the correct circumferential position and that the groups themselves comprise the correct number of nominally cambered, overcambered and undercambered vanes.

The variation in camber between the nominally cambered vane and the adjacent over- or undercambered vanes is only 4° to 8°. It is therefore almost impossible to distinguish the nominally cambered vane from the over- or undercambered vanes by eye alone.

By providing each of the nominally cambered vane and an endmost of each of the undercambered and overcambered vanes in a group of vanes with a respective inspection feature, it becomes possible to identify each of these types of vane simply by measuring some aspect (for example, a length) of the inspection feature.

In one embodiment of the invention, the inspection feature takes the form of a tang which protrudes from the outer platform of the vane. By measuring the length of the tang and its circumferential position, it is possible to identify the vanes at each end of a group and also to identify the nominally cambered vane positioned within the group. This in turn makes it possible to confirm that the groups of vanes are correctly circumferentially positioned in the stator stage.

This check can be carried out using a simple GO/NO GO type inspection gauge which makes it easy for a user to quickly determine the quantity and order of vanes in the assembled stator stage.

This enables a user to check that each group of vanes comprises the correct quantity of vanes, that the the ordering of the vanes within the group is correct and, most importantly, that the group of vanes is correctly positioned circumferentially in the stator stage.

Optionally, the turbine engine stator stage further comprises a plurality of nominally cambered spacing vanes and wherein step (d) comprises the step of:

(d1) positioning the groups of vanes in a pre-determined order, with each group being separated from an adjacent group by at least one spacing vane to form the assembled stator stage.

When assembling the stator stage, each of the pre-assembled groups of vanes is separated by one or more spacing vanes. This enables specific groups of vanes to be positioned at the required circumferential position within the stator stage in order to achieve the required modification to the airflow through the stator stage.

Optionally, the spacing vane has a width, and the assembled stator stage has an expansion gap, and wherein step (d1) comprises the additional initial step of:

(d1a) selecting a plurality of nominally cambered spacing vanes on the basis of the width of each spacing vane such that, when the groups of vanes are positioned in a pre-determined order to form the assembled stator stage, the expansion gap is within a predetermined limit.

Due to the thermal loads experienced by the gas turbine engine during operation, it is necessary to provide an expansion gap in the assembled stator stage. This is necessary to allow the stator stage to expand as the engine reaches its operating temperature without such expansion imposing additional loads on the casing assembly.

However, if the expansion gap is excessive, the aerodynamic losses caused by air leakage through the gap can reduce the efficiency of the engine. It is therefore essential that the expansion gap of the assembled stator stage falls within predefined limits.

The use of spacing vanes which have a range of nominal widths enables the separate groups of vanes to be positioned at the appropriate circumferential position in the stator stage whilst also enabling the expansion gap of the assembled stator stage to be controlled to the required limits.

According to a second aspect of the present invention there is provided a turbine engine stator stage comprising a plurality of vanes, each of the plurality of vanes having a camber angle, the plurality of vanes being arranged in a plurality of groups, each group comprising a pre-determined sequence of vanes, the ordering of vanes within the sequence being determined by the camber of the individual vanes, and the circumferential position of each group within the stator stage being predetermined.

Optionally, each group comprises one nominally cambered vane, at least one overcambered vane and at least one undercambered vane.

Optionally, each of the plurality of vanes comprises an inner platform and an outer platform, each of the inner and outer platforms having a first side and an opposite second side, the first side of the inner platform of the nominally cambered vane and the second side of the inner platform of each of the at least one over-cambered vanes in each group each having respective co-operating angled first and second sides which enables each of the at least one over-cambered vanes to be consecutively positioned abutting the first side of the nominally cambered vane, and the second side of the outer platform of the nominally cambered vane and the first side of the outer platform of each of the at least one under-cambered vanes in each group each having respective co-operating angled second and first sides which enables each of the at least one under-cambered vanes to be consecutively positioned abutting the second side of the nominally cambered vane.

The presence of angled sides on the interfacing sides of the inner platforms of the nominally cambered vane and the over-cambered vanes means that the overcambered vanes can only be positioned on a first side of the nominally cambered vane if the resulting assembly of vanes is to form a planar group of vanes which can then form part of the assembled stator stage.

Similarly, the presence of angled sides on the interfacing sides of the outer platforms of the nominally cambered vane and the under-cambered vanes results in the under-cambered vanes only being positionable on an opposite, second side of the nominally cambered vane to the over-cambered vanes.

Consequently, the feature of co-operating pairs of sides on inner and outer platforms of the vanes means that the over-cambered and under-cambered vanes must be positioned on opposite sides of the nominally cambered vane. This makes it simpler for a user to assemble a group of vanes.

Optionally, the nominally cambered vane and the endmost of each of the is undercambered and overcambered vanes in a group of vanes each comprise a respective inspection feature having a length, the length of the respective inspection feature identifying the nominally cambered vane and the undercambered and overcambered vanes at respective opposite ends of the sequence of vanes in the group.

Optionally, the plurality of groups of vanes comprises at least two groups of vanes, each group having a different sequence of over-cambered, nominally cambered and under-cambered vanes to each other group.

Optionally, each group of vanes is separated from an adjacent group by at least one nominally cambered spacing vane.

Optionally, the stator stage further comprises an expansion gap and the spacing vane has a width such that the expansion gap of the assembled stator stage is within a predetermined limit.

According to a third aspect of the present invention there is provided a turbine engine stator stage comprising a plurality of groups of vanes, each group of vanes comprising a nominally cambered vane, at least one over-cambered vane and at least one under-cambered vane, each of the vanes comprising an inner platform and an outer platform, each of the inner and outer platforms having a first side and an opposite second side, wherein within each group;

the first side of the inner platform of the nominally cambered vane and the second side of the inner platform of each of the over-cambered vanes each having respective co-operating angled first and second sides which enables each of the over-cambered vanes to be consecutively positioned abutting the first side of the nominally cambered vane, and the second side of the outer platform of the nominally cambered vane and the first side of the outer platform of each of the under-cambered vanes each having respective co-operating angled second and first sides which enables each of the under-cambered vanes to be consecutively positioned abutting the second side of the nominally cambered vane.

According to a fourth aspect of the present invention there is provided a turbine engine comprising a stator stage, the stator stage comprising a plurality of vanes, each of the plurality of vanes having a camber angle, the plurality of vanes being arranged in a plurality of groups, each group comprising a pre-determined sequence of vanes, the ordering of vanes within the sequence being determined by the camber of the individual vanes, and the circumferential position of each group within the stator stage being predetermined.

Other aspects of the invention provide devices, methods and systems which include and/or implement some or all of the actions described herein. The illustrative aspects of the invention are designed to solve one or more of the problems herein described and/or one or more other problems not discussed.

BRIEF DESCRIPTION OF THE DRAWINGS

There now follows a description of an embodiment of the invention, by way of non-limiting example, with reference being made to the accompanying drawings in which.

It is noted that the drawings may not be to scale. The drawings are intended to depict only typical aspects of the invention, and therefore should not be considered as limiting the scope of the invention. In the drawings, like numbering represents like elements between the drawings.

DETAILED DESCRIPTION

Figure 1:
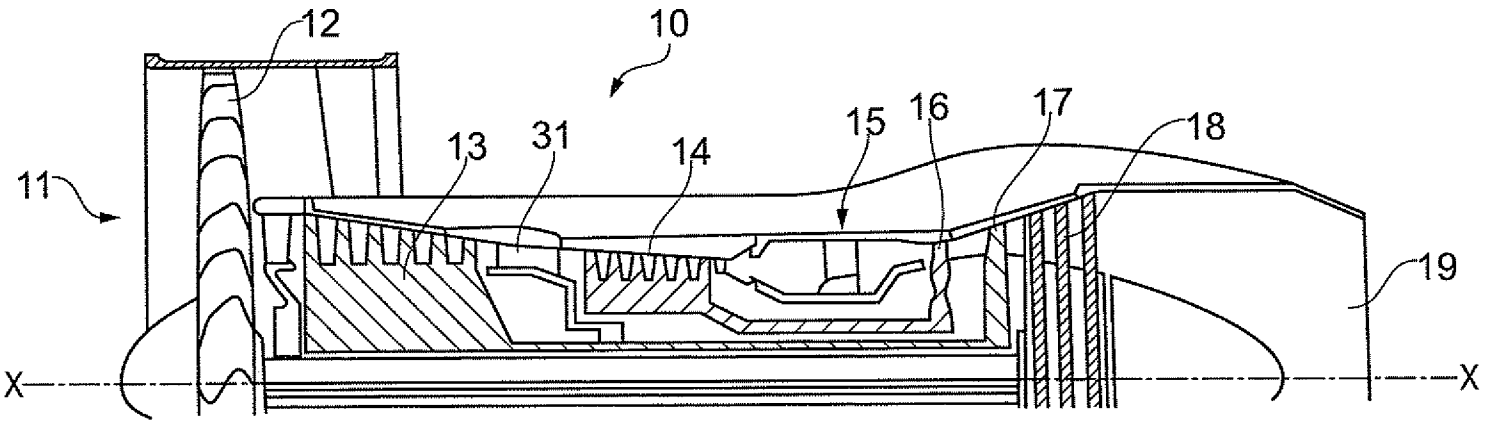
FIG. 1 shows a schematic sectional view of conventional gas turbine engine.
Figure 2:
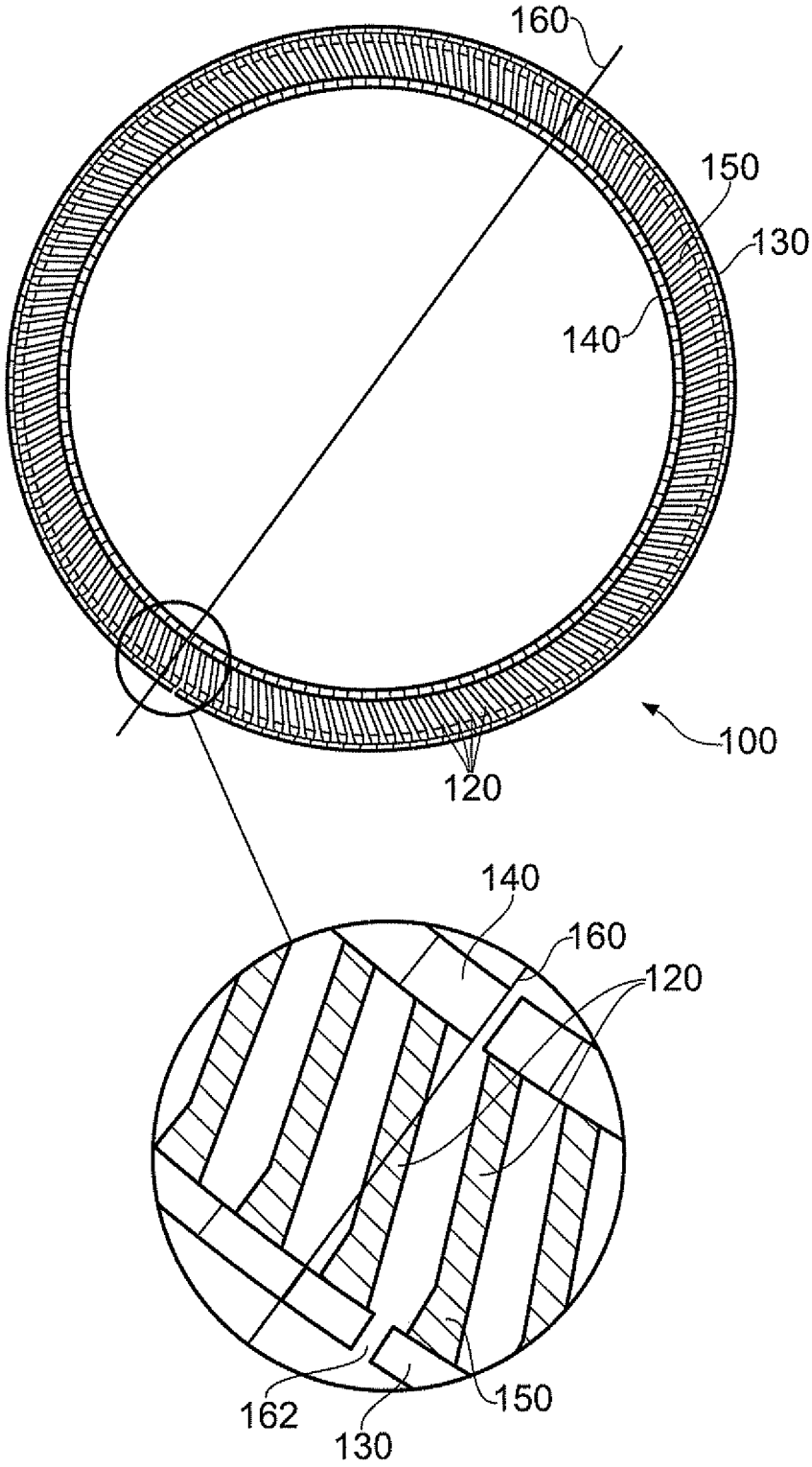
FIG. 2 shows an axial view of a turbine engine stator stage.
Figure 3:
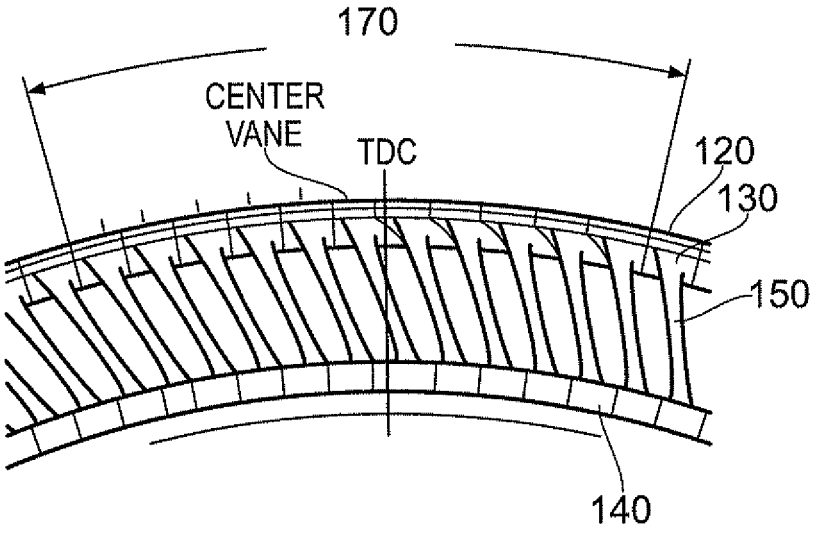
FIG. 3 shows a partial axial view of a turbine engine stator according to the present invention, showing a group of vanes.
Figure 4:
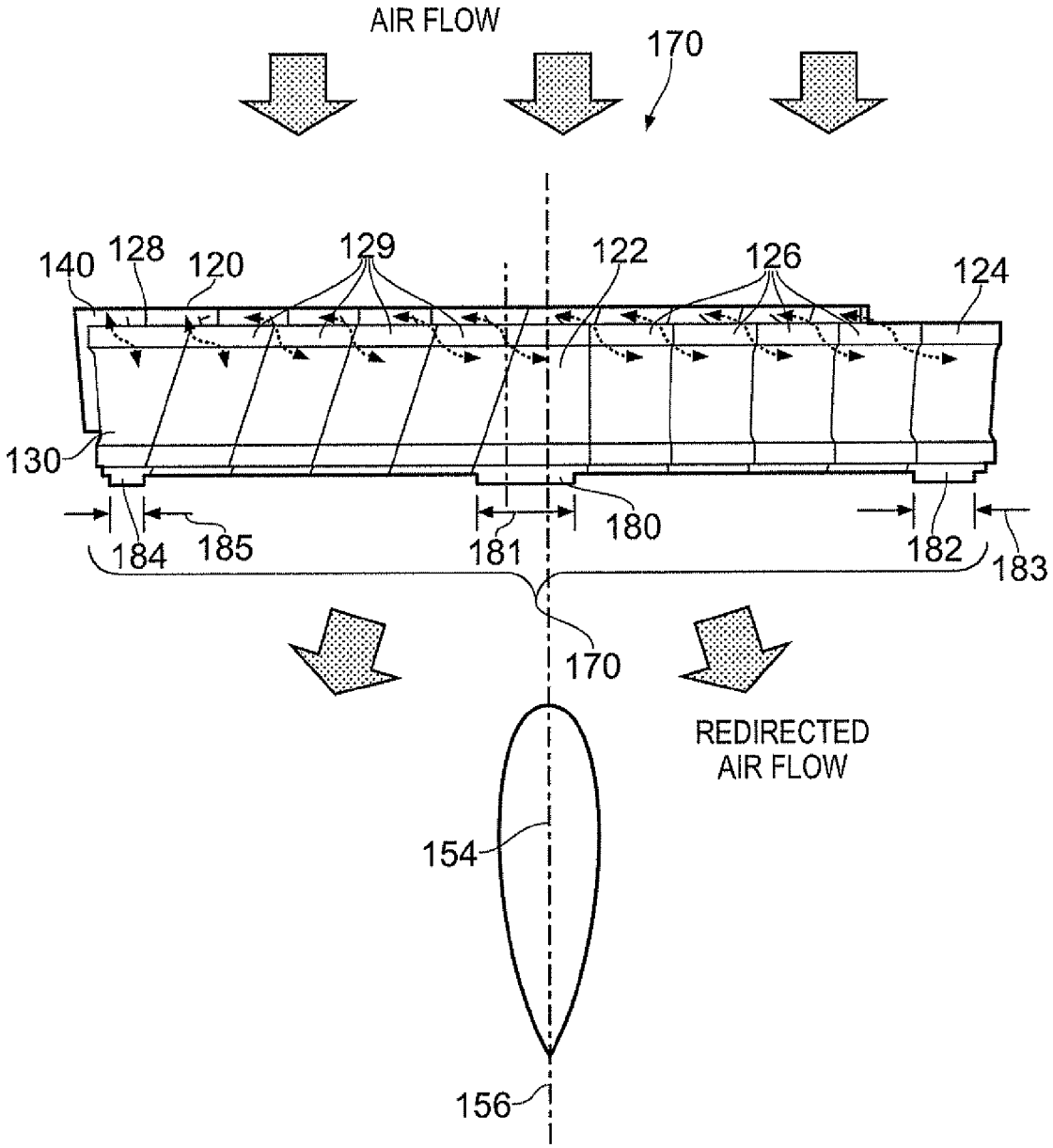
FIG. 4 shows an end view of the group of vanes of FIG. 3.

Referring to FIGS. 2 to 4, a turbine engine stator stage according to the invention is designated generally by the reference numeral 100.

The stator stage 100 comprises a plurality of stator vanes 120 which are arranged circumferentially in groups 170 to form the assembled stator stage 100 which is located inside the engine casing (not shown). The engine casing is split axially into two halves into each of which is assembled half of the stator stage 100. The two half engine casings are then joined at a later stage of the engine assembly to form the complete stator stage 100. The complete stator stage 100 is provided with an expansion gap 162 which allows for thermal expansion of the stator stage as the engine reaches its operating temperature.

Each of the vanes 120 comprises an outer platform 130 which is integrally formed with an aerofoil portion 150 and an inner platform 140. The aerofoil portion 150 is cambered relative to the axis of the stator stage 100.

The method of assembling the stator stage involves sliding individual vanes 120 into each of the engine casing halves in a predetermined sequence. The respective outer platforms 130 and inner platforms 140 of adjacent vanes 120 abut closely against one another in a circumferential manner.

In a gas turbine engine it is often necessary to provide strut assemblies 154, which extend radially inwards from the engine casing, in order to support the shaft assembly. These strut assemblies 154 necessarily intrude into the air flow as it passes through the engine and may result in a loss of aerodynamic efficiency for the engine.

In order to compensate for the adverse effects of these struts 154 on the airflow entering the compressor, the stator stage 100 comprises vanes 120 having a range of discrete camber values. Each vane 120 is configured as a vane 122 having a nominal camber angle, a vane 124,126 having a camber angle greater than the nominal angle (over-cambered) or a vane 128,129 having a camber less than the nominal angle (under-cambered).

FIGS. 3 and 4 show one such group 170 of vanes 120 having a single central nominally cambered vane 122 with five over-cambered vanes 124,126 positioned on one side of the central vane 122 and five under-cambered vanes 128,129 positioned on the other side of the central vane 122.

The single nominally cambered vane 122 is aligned with the axis 156 of the strut 154. In this way, as shown in FIG. 4, the over-cambered and under-cambered vanes 124,126,128, 129 serve to direct the airflow around the strut 154. This has the effect of reducing the pressure loss caused by the presence of the strut 154 in the airflow, which in turn improves the efficiency of the engine.

While the arrangement of vanes 120 within the group shown in FIGS. 3 and 4 is symmetrical around the central vane 122, in other embodiments of the invention this arrangement may be asymmetrical.

Figure 5:
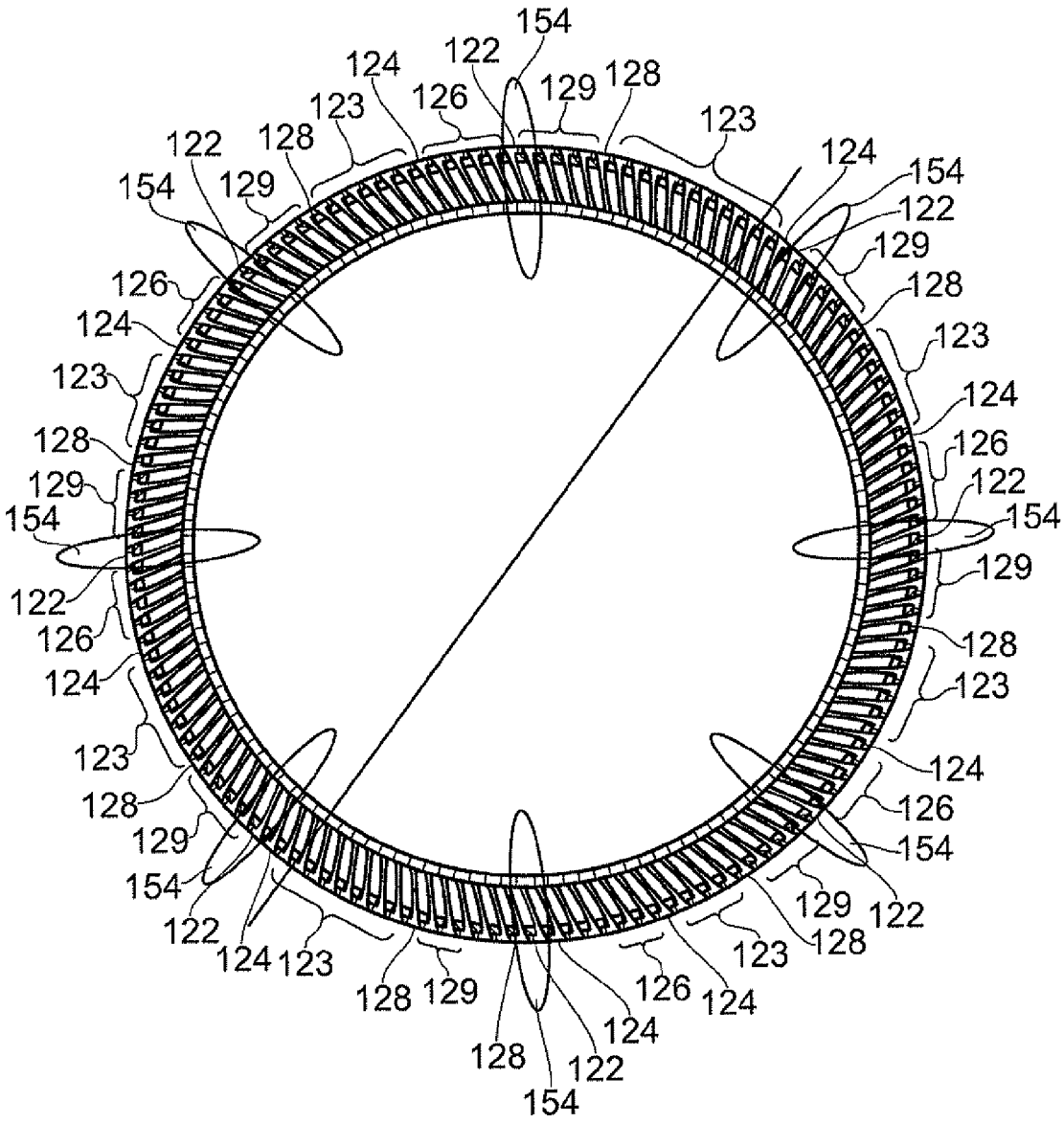
FIG. 5 shows the stator stage of FIG. 2 in which the circumferential positions of the groups of vanes is shown.

When positioning the vanes 120 in the casing it is necessary to ensure that in each group 170 of vanes 120 the centre or nominally cambered vane 122 is aligned with a corresponding downstream mounted strut 154, as illustrated in FIG. 5.

Figure 6:
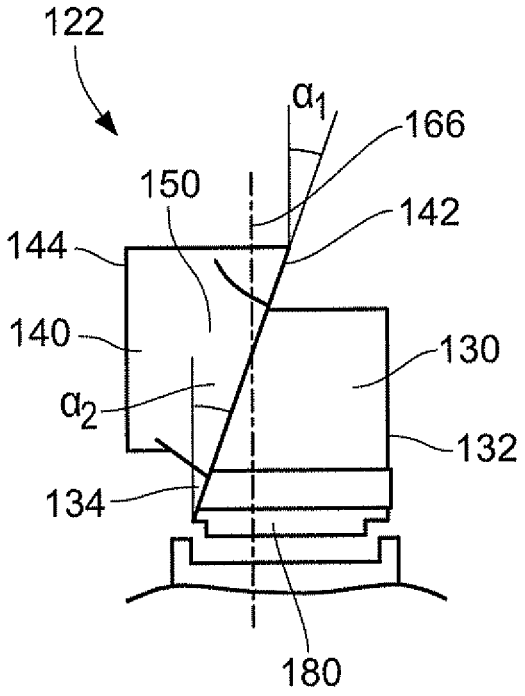
FIG. 6 is a perspective end view of a nominally cambered vane from the group of vanes of FIG. 3, showing the inspection feature.
Figure 7A:
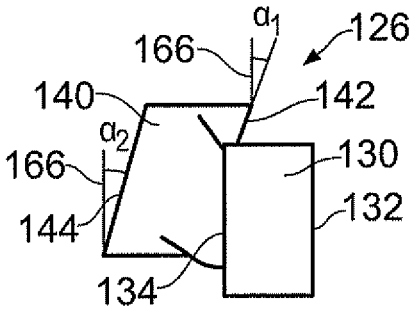
FIGS. 7*a* and 7*b* show perspective end views of over-cambered end and mid vanes.
Figure 7B:
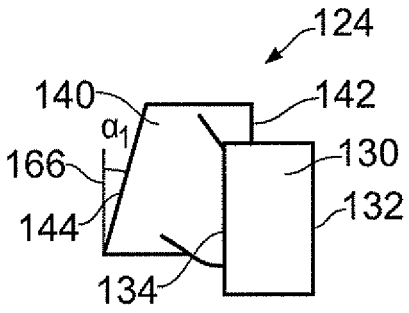
Figure 8A:
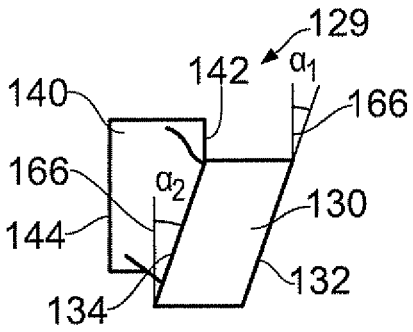
FIGS. 8*a* and 8*b* show perspective end views of under-cambered end and mid vanes.
Figure 8B:
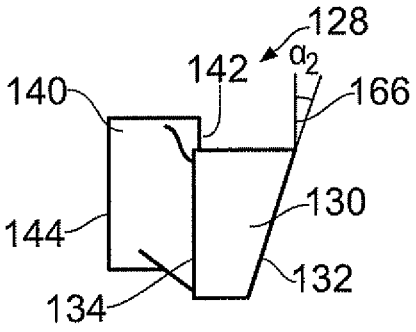

As shown in FIGS. 6 to 8, the outer platform 130 of each vane has a first side 132 and an opposite second side 134, and the inner platform 140 of each vane 120 has corresponding first 142 and second 144 sides.

As shown in FIGS. 3 and 4, the nominally cambered vane 122 is positioned between over-cambered vanes 124,126 and under-cambered vanes 128,129. The first sides 132,142 of the outer and inner platforms 130,140 of the central nominally cambered vane 122 are configured to abut against the corresponding second sides 134,144 of the over-cambered vanes 124,126. Similarly, the second sides 134,144 of the outer and inner platforms 130,140 of the nominally cambered vane 122 are arranged to abut against the corresponding first sides 132,142 of the under-cambered vanes 128,129.

Within each group 170 of vanes 120, the first and second sides of each of the co-operating outer and inner platforms 130,140 are configured with a combination of sides either parallel to or angled relative to the axis of the stator stage 100.

The outermost side of each outermost vane in each group 170 of vanes 120 is parallel to the stator stage 100 axis. This ensures that groups 170 of vanes can be assembled as part of the stator stage 100 in various different circumferential arrangements.

This requirement means that each of the over-cambered 124,126 and under-cambered vanes 128,129 must be available in both end 124,128 (i.e. the end vane in a group) and mid 126,129 (i.e. between the nominally cambered vane 170 and an end vane) configurations.

Turning now to the configuration of the group 170 shown in FIGS. 3 and 4, the first side 132 of the outer platform 130 of the nominally cambered vane 122 (FIG. 5) is parallel to the axis 166 of the stator stage 100 while the first side 142 of the inner platform 140 is angled at an angle $\alpha_1$ to the stator assembly axis 166.

As shown in FIGS. 6*a* and 6*b*, the second side 134 of the outer platform 130 of both the end and mid over-cambered vanes 124,126 is parallel to the stator assembly axis 166 and the second side 144 of the inner platform 140 of these vanes 124,126 is angled at an angle $\alpha_1$ to the stator assembly axis 166. This enables either of the end or mid over-cambered vanes 124,126 to abut against the first side 132,142 of the nominally cambered vane 122.

If the group 170 of vanes is to comprise more than one over-cambered vane 124,126, such as, say, five over-cambered vanes 124,126, as shown in FIGS. 3 and 4, the group 170 will include one end 124 and four mid 126 over-cambered vanes.

In a similar manner, the second side 134 of the outer 130 platform of the nominally cambered vane 122 (FIG. 5) is angled at an angle $\alpha_2$ to the stator assembly axis 166 while the second side 144 of the corresponding inner platform 140 is parallel to the axis of the stator stage 100.

In order for the under-cambered vanes 128,129 to abut correctly against the second side 134,144 of the nominally cambered vane 122, the first side 132 of the outer platform 130 of both the end and mid under-cambered vanes 128,129 is angled at an angle $\alpha_2$ to the stator assembly axis 166 and the first side 142 of the inner platform 140 of each of these vanes 128,129 is parallel to the stator assembly axis 166.

In the present embodiment of the invention the angles $\alpha_1$ and $\alpha_2$ are identical to one another. However in other embodiments these angles may be different to one another.

The pre-assembled groups 170 of vanes 120 are then positioned in the compressor casing in a pre-determined sequence to form the completed stator stage 100.

As the groups 170 of vanes 120 are positioned in the casing, the circumferential position of each of the nominally cambered vanes 122 is checked to ensure that it corresponds to the axis 156 of a strut 154.

In order to correctly position the groups 170 of vanes 120 circumferentially, one or more spacing vanes 123 are positioned between the groups 170. The spacing vanes 123 are nominally cambered vanes which are available in a number of different widths, i.e. the distance between the first and second sides of the platforms. By selecting different quantities and widths of spacing vanes it becomes possible to accurately position the groups 170 of vanes 120 circumferentially around the stator stage 100 and thereby to position the nominally cambered vanes immediately upstream of a corresponding strut.

The present invention may be embodied in other specific forms without departing from its spirit or essential characteristics. The described embodiments are to be considered in all respects only as illustrative and not restrictive. The scope of the invention is therefore indicated by the appended claims rather than by the foregoing description. All changes which come within the meaning and range of equivalency of the claims are to be embraced within their scope.

What is claimed is:

1. A method of assembling a turbine engine stator comprising a plurality of vanes, each of the plurality of vanes having a camber angle, the method comprising the steps of:

(a) selecting a group of vanes based on the camber angle of each of the plurality of vanes;

(b) selecting a nominally cambered vane;

(c) positioning at least one over-cambered vane on a first side of the nominally cambered vane and at least one under-cambered vane on an opposite, second side of the nominally cambered vane, each of the nominally cambered vane and an endmost of each of the under-cambered and over-cambered vanes in a group of vanes having a respective inspection feature, each inspection feature having a length;

(d) repeating steps (a) to (c) to form a plurality of groups of vanes; and (e) positioning the groups of vanes in a pre-determined order such that each group of vanes is positioned at a predefined circumferential position in the assembled stator stage;

(f) measuring the length and circumferential position of each of the inspection features;

(g) identifying the nominally cambered vane, and the under-cambered and over-cambered vanes at respective opposite ends of the sequence of vanes in each group on the basis of the length of the respective inspection feature;

(h) confirming that the circumferential position of each of the nominally cambered vanes and the over-cambered and under-cambered end vanes in each group matches the corresponding predefined circumferential position; and (i) confirming that the sequence of vanes in each group matches the respective pre-determined sequence on the basis of the quantities of over-cambered and under-cambered vanes which are present on respective opposite sides of the nominally cambered vane.

2. A method as claimed in claim 1, wherein step (a) comprises the steps of:

(a1) selecting a nominal vane camber angle for the stator stage;

(a2) selecting at least one overcamber angle, being greater than the nominal camber angle, and at least one under-camber angle, being less than the nominal camber angle; and (a3) selecting a group of vanes comprising one nominally cambered vane, at least one over-cambered vane, and at least one under-cambered vane.

3. A method as claimed in claim 1, the turbine engine stator stage further comprises a plurality of nominally cambered spacing vanes, wherein step (e) comprises the step of:

(e1) positioning the groups of vanes in a pre-determined order, with each group being separated from an adjacent group by at least one spacing vane to form the assembled stator stage.

4. A method as claimed in claim 3, wherein the spacing vane has a width, and the assembled stator stage has an expansion gap, and wherein step (e1) comprises the additional initial step of:

(e1a) selecting a plurality of nominally cambered spacing vanes on the basis of the width of each spacing vane such that, when the groups of vanes are positioned in a pre-determined order to form the assembled stator stage, the expansion gap is within a predetermined limit.

5. A turbine engine stator stage comprising a plurality of vanes, each of the plurality of vanes having a camber angle, each of the plurality of vanes comprising an inner platform and an outer platform, each of the inner and outer platforms having a first side and an opposite second side, the first side of the inner platform of the nominally cambered vane and the second side of the inner platform of each of the at least one over-cambered vanes in each group each having respective co-operating angled first and second sides which enables each of the at least one over-cambered vanes to be consecutively positioned abutting the first side of the nominally cambered vane, and the second side of the outer platform of the nominally cambered vane and the first side of the outer platform of each of the at least one under-cambered vanes in each group each having respective co-operating angled second and first sides which enables each of the at least one under-cambered vanes to be consecutively positioned abutting the second side of the nominally cambered vane, and the plurality of vanes being arranged in a plurality of groups, each group comprising a pre-determined sequence of vanes, the ordering of vanes within the sequence being determined by the camber of the individual vanes, and the circumferential position of each group within the stator stage being predetermined.

6. A stator stage as claimed in claim 5, wherein each group comprises one nominally cambered vane, at least one over-cambered vane and at least one under-cambered vane.

7. A stator stage as claimed in claim 6, wherein the nominally cambered vane and the endmost of each of the under-cambered and over-cambered vanes in a group of vanes each comprise a respective inspection feature having a length, the length of the respective inspection feature identifying the nominally cambered vane and the under-cambered and over-cambered vanes at respective opposite ends of the sequence of vanes in the group.

8. A stator stage as claimed in claim 6, wherein the plurality of groups of vanes comprises at least two groups of vanes, each group having a different sequence of over-cambered, nominally cambered and under-cambered vanes to each other group.

9. A stator stage as claimed in claim 6, wherein each group of vanes is separated from an adjacent group by at least one nominally cambered spacing vane.

10. A stator stage as claimed in claim 9, further comprising an expansion gap and wherein the spacing vane has a width such that the expansion gap of the assembled stator stage is within a predetermined limit.

11. A turbine engine comprising a stator stage as claimed in claim 5.

12. A turbine engine stator stage comprising a plurality of groups of vanes, each group of vanes comprising a nominally cambered vane, at least one over-cambered vane and at least one under-cambered vane, each of the vanes comprising an inner platform and an outer platform, each of the inner and outer platforms having a first side and an opposite second side, wherein within each group;

the first side of the inner platform of the nominally cambered vane and the second side of the inner platform of each of the over-cambered vanes each having respective co-operating angled first and second sides which enables each of the over-cambered vanes to be consecutively positioned abutting the first side of the nominally cambered vane, and the second side of the outer platform of the nominally cambered vane and the first side of the outer platform of each of the under-cambered vanes each having respective co-operating angled second and first sides which enables each of the under-cambered vanes to be consecutively positioned abutting the second side of the nominally cambered vane.

* * * * *